US012790936B2

(12) United States Patent
Sharp et al.

(10) Patent No.: US 12,790,936 B2
(45) Date of Patent: Nov. 10, 2026

(54) APPARATUSES AND METHODS FOR ABANDONMENT OF WELLS HAVING A SENSOR

(71) Applicants: NUWAVE INDUSTRIES INC., Marwayne (CA); Strat-Log Technologies Ltd., Calgary (CA)

(72) Inventors: Tim Sharp, Marwayne (CA); Lars Hinrichs, Canmore (CA)

(73) Assignees: NUWAVE INDUSTRIES INC., Marwayne (CA); STRAT-LOG TECHNOLOGIES LTD., Canmore (CA)

( * ) Notice: Subject to any disclaimer, the term of this patent is extended or adjusted under 35 U.S.C. 154(b) by 237 days.

(21) Appl. No.: 18/844,691

(22) PCT Filed: Mar. 9, 2023

(86) PCT No.: PCT/CA2023/050310
§ 371 (c)(1),
(2) Date: Sep. 6, 2024

(87) PCT Pub. No.: WO2023/168528
PCT Pub. Date: Sep. 14, 2023

(65) Prior Publication Data

US 2026/0251056 A1 Aug. 27, 2026

Related U.S. Application Data

(60) Provisional application No. 63/318,017, filed on Mar. 9, 2022.

(51) Int. Cl.
*E21B 47/017* (2012.01)
*E21B 29/00* (2006.01)

(52) U.S. Cl.
CPC ..... *E21B 47/017* (2020.05); *E21B 29/00* (2013.01); *E21B 29/005* (2013.01)

(58) Field of Classification Search
CPC ..... E21B 47/017; E21B 29/00; E21B 29/005; E21B 29/002; E21B 33/13; E21B 43/114; E21B 41/0078; B24C 3/32; B24C 3/325; B24C 1/045
See application file for complete search history.

(56) References Cited

U.S. PATENT DOCUMENTS

| | | | | |
|---|---|---|---|---|
| 7,178,598 | B2 | 2/2007 | Lund | |
| 8,820,396 | B2 | 9/2014 | Cumby | |
| 10,161,216 | B2 * | 12/2018 | Samuelson | E21B 33/13 |
| 10,774,606 | B2 * | 9/2020 | Gromes, Sr. | B24C 3/32 |
| 11,002,095 | B2 * | 5/2021 | Gromes, Sr. | E21B 29/002 |

(Continued)

FOREIGN PATENT DOCUMENTS

CA 2956165 A1 7/2017

*Primary Examiner* — Yong-Suk (Philip) Ro
(74) *Attorney, Agent, or Firm* — Dilworth & Barrese, LLP.; Michael J. Musella, Esq.

(57) ABSTRACT

Adaptors for a cutter head of a cutting device are described herein. The adaptors have a base plate at least partially defining a sensor aperture shaped to receive a sensor cable, and an attachment bracket for receiving the cutter head, the attachment bracket extending from a top face of the base plate. Method for abandoning and capping a well with a sensor cable are also described herein.

19 Claims, 8 Drawing Sheets

(56) References Cited

U.S. PATENT DOCUMENTS

| | | | | |
|---|---|---|---|---|
| 2010/0236774 | A1* | 9/2010 | Patel | E21B 17/0283 702/6 |
| 2013/0112393 | A1* | 5/2013 | Cumby | E21B 29/005 166/55 |
| 2015/0211202 | A1 | 7/2015 | Melancon | |
| 2018/0021922 | A1 | 1/2018 | Linde | |
| 2019/0001456 | A1 | 1/2019 | Kalhori | |
| 2022/0178246 | A1* | 6/2022 | Hird | E21B 10/42 |
| 2022/0195824 | A1* | 6/2022 | Scharf | E21B 29/002 |

* cited by examiner

APPARATUSES AND METHODS FOR ABANDONMENT OF WELLS HAVING A SENSOR

RELATED APPLICATIONS

This application claims priority to U.S. provisional application No. 63/318,017 filed Mar. 9, 2022 and herein incorporated by reference in its entirety.

FIELD OF INVENTION

The present invention relates to devices and methods for well abandonment, more specifically apparatuses and methods for protecting instrumentation during well abandonment procedures.

BACKGROUND OF THE INVENTION

When a pipeline or well is no longer used, various segments may be abandoned to avoid long term impact on the surrounding environment. Instrumentation, such as a sensor or instrument cable, may be run to monitor the well and/or the surrounding environment prior, during and/or after abandonment of the well. Often, the instrumentation is left in a wellbore at the end of life state, so that data can be extracted after the abandonment process is complete.

The abandonment process may require several labour-intensive steps. For example, the geological formations of a well, such as a delineation or stratigraphic well, may be first sampled/drilled via coring or wireline logging processes. Once the well is drilled to a total depth (TD), a sacrificial tubing (or casing) string may be run to TD to provide a flow path for filler material, such as cement.

With tubing (having a diameter of, for example, about 38.1 mm-88.9 mm), or casing (having a diameter of, for example, about 114 mm to 177 mm) in place, the sensor cable may be gravity fed from surface to TD. In some cases, the tubing/casing will be pulled up from TD to a certain distance to provide a flow path and the sensor cable may be deployed such that a tip of the cable stays within the tubing/casing and provide a solid cement barrier between the sensor cable and the end of tubing. The sensor cable may then be depth correlated and temporarily hung or fastened in a wellhead hanger prior to addition of filler material. In some cases, one or more sensor cables may be strapped or clamped to the outside of the tubing or casing when abandoned.

Filler material is then pumped down the tubing (or casing) and circulated down to TD and up the annulus. This process is typically continued until cement returns are seen at surface—in some cases both inside and outside of tubing (or casing) are cemented. In some cases, the tubing or casing is cemented in multiple stages and/or to different subsurface levels set by local regulations. After this process, the well is considered downhole (or subsurface) abandoned.

After downhole abandonment, the well may need to be surface abandoned, sometimes referred to as a "cut-and-cap" procedure. Often, this procedure involves cutting the well casing to a minimum distance below the surface (such as one meter or 3.281 feet or more). A vented cap is then placed atop the well casing. Cutting of the well casing during surface abandonment presents many problems, such as accidental damage to the sensor cable that runs from the surface to the TD of the well. If the cable is damaged, it may be difficult to obtain valuable sub-surface data from the well. A damaged cable may present additional challenges as the well and bottom portion of the cable have been sealed with cement, making repair or replacement difficult.

Safer, more reliable and/or more convenient methods are desired to address deficiencies known in the art.

SUMMARY OF THE INVENTION

The present invention relates to apparatuses and methods for abandonment of a well with a sensor cable disposed therein. Such apparatuses and methods allow for protection and management of the sensor cable during abandonment.

According to the present invention there is provided an adaptor for a cutter head of a cutting device, the adaptor comprising: a base plate at least partially defining a sensor aperture shaped to receive a sensor cable, an attachment bracket for receiving the cutter head, the attachment bracket extending from a top face of the base plate, and, optionally, a fastener for securing the attachment bracket to the cutter head, wherein the sensor aperture is positioned such that the sensor aperture is outside a cutting path of a cutter tip of the cutter head in use.

In further embodiments, an adjustment element is removably secured to the base plate. In such embodiments and others, the sensor aperture is formed by the base plate and the adjustment element.

In some embodiments, the sensor cable is a thermocouple, a fiber optic sensor, a geophone, a magnetic coil, a pressure sensor, or a combination thereof.

In some embodiments, the sensor aperture is adjacent to the attachment bracket.

In further embodiments, the cutting path defines a central cutting axis, and the sensor aperture at least partially overlaps with the cutting axis. In yet further embodiments, the cutting path is at least partially defined by a path of output from the cutter tip.

In some embodiments, the output is a mixture of abrasive and ultra-high pressure (UHP) fluid. In such embodiments and others, the cutting device is an ultra-high pressure (UHP) cutting device.

In some embodiments, the adaptor is for use in a well. In further embodiments, the well is a stratigraphic test well, a non-thermally compliant well or an observation well. In yet further embodiments, the well is at least partially filled by filler material, such as concrete. In some embodiments, the well is cemented to surface.

In some embodiments, the adaptor further comprises an upper guide mounted on the attachment bracket for attaching to the sensor cable.

According to the present invention there is provided an ultra-high pressure (UHP) cutting device for insertion into a wellbore for cutting the casing of the wellbore from within the wellbore while managing a sensor cable, the UHP cutting device comprising: a UHP hose connector for connection with a UHP hose in communication with a fluid source, a rotatable UHP tube with a top end in fluid communication with the UHP hose connector and a bottom end opposite the top end, a rotating means in operational communication with the UHP tube for rotating the UHP tube during operation of the cutting device, a cutter head in fluid communication with the bottom end of the UHP tube, the cutter head comprising: a UHP elbow for changing the direction of UHP fluid flow from a direction substantially parallel with the wellbore to a direction toward the inner surface of the wellbore, an abrasive feed port for connection with an abrasive feed line for receiving abrasive to be mixed with the UHP fluid, and a focus tube for directing the mixture of UHP fluid and abrasive out of the cutter head and toward the inner surface of the wellbore to be cut, and an adaptor for a cutter head of a cutting device for managing a sensor cable, the adaptor comprising: a base plate at least partially defining a sensor aperture shaped to receive the sensor cable, an attachment bracket for receiving the cutter head, the attachment bracket extending from a top face of the base plate, and a fastener for securing the attachment bracket to the cutter head, wherein the sensor aperture is positioned from a cutter tip of the cutter head, such that the sensor aperture is outside a cutting path of the cutter tip in use.

According to the present invention there is provided a method for abandoning and capping a well with a sensor cable, the method comprising: inserting the cutting device into the well to a first depth, spacing the sensor cable from a cutting path of the cutting device via an adaptor, cutting the well at the first depth with the cutting device, and capping the well with a ported vented cap to allow passage of the sensor cable to the ground surface. In further embodiments, the methods comprise feeding the sensor cable through the adaptor for a cutting device. In some embodiments, the methods further comprise providing a protective cap for the sensor cable protruding from the ported vented cap to shield the sensor cable.

In further embodiments, the method comprises feeding a tubing string into the well until the tubing string reaches an area proximate a true depth of the well.

In yet further embodiments, the method comprises feeding the sensor cable into the tubing string until the sensor cable reaches the true depth of the well for data collection. In these and other embodiments, a sensor cable is inserted exterior to the well at a suitable depth.

In further embodiments, the methods comprise filling the tubing string with a first filler to a first depth within the well to seal the well, the tubing string and the sensor cable.

In some embodiments, the method comprises attaching the adaptor to a cutter head of the cutting device.

In some embodiments, the first depth is 0.5-10 meters. In such embodiments and others, the first depth is 1-5 meters.

In further embodiments, the method comprises, after providing a protective cap, pouring a second filler onto the first filler. In some embodiments, the first filler is a cementitious material.

In some embodiments, the second filler is soil. In other embodiments, the sensor cable comprises a thermocouple, a fiber optic sensor, a geophone, a magnetic coil, an electric based sensor, a pressure gauge, or a combination thereof.

In some embodiments, the sensor cable is gravity fed or pumped to a true depth of the well. In such embodiments and others, the sensor cable may be clamped or strapped to an exterior of the tubing or casing of the well.

In further embodiments, the methods comprise geolocating the well. In yet further embodiments, the methods comprise accessing the sensor cable via a surface box to download data collected by the sensor cable. In further embodiments, the methods comprise reclaiming land surrounding the well after the data has been collected.

According to the present invention there is provided a method for abandoning and capping a well with a sensor cable, the method comprising: feeding a tubing string into the well until the tubing string reaches an area proximate a true depth of the well, feeding the sensor cable into the tubing string until the sensor cable reaches the true depth of the well, filling the tubing string with a first filler to a first depth within the well to seal the well, the tubing string and the sensor cable, removing a portion of the first filler to a first depth, feeding the sensor cable through an adaptor for a cutting device, inserting the cutting device into the well to the first depth, cutting the well at the first depth with the cutting device, capping the well with a ported vented cap to allow passage of the sensor cable to the ground surface, and providing a protective cap for the sensor cable protruding from the ported vented cap to shield the sensor cable.

In further embodiments of the above methods, the cutting device is an UHP hydro-jet cutting device. In some embodiments, the cutting device is an internal cutting device sized to fit within the wellbore to be cut.

According to the present invention there is provided a vented cap comprising: a base defining a passage therethrough, the base having a top face and an opposing bottom face, and a lip extending from or adjacent to an outer perimeter of the bottom face for sealing against a part of a well to be abandoned.

In some embodiments, the vented cap further comprises a spool extending from the bottom face for receiving a sensor cable. In further embodiments, the spool has a substantially frustoconical, cylindrical or conical shape.

In further embodiments, the vented cap comprises a side wall extending from the top side. In even further embodiments, the base and side wall form an interior for housing the sensor cable. In yet further embodiments, the vented cap comprises a removable cover. The removable cover may comprise an anchor for attaching a free end of the sensor cable.

This summary of the invention does not necessarily describe all features of the invention.

BRIEF DESCRIPTION OF THE DRAWINGS

These and other features of the invention will become more apparent from the following description in which reference is made to the appended drawings wherein.

DETAILED DESCRIPTION

Figure 2:
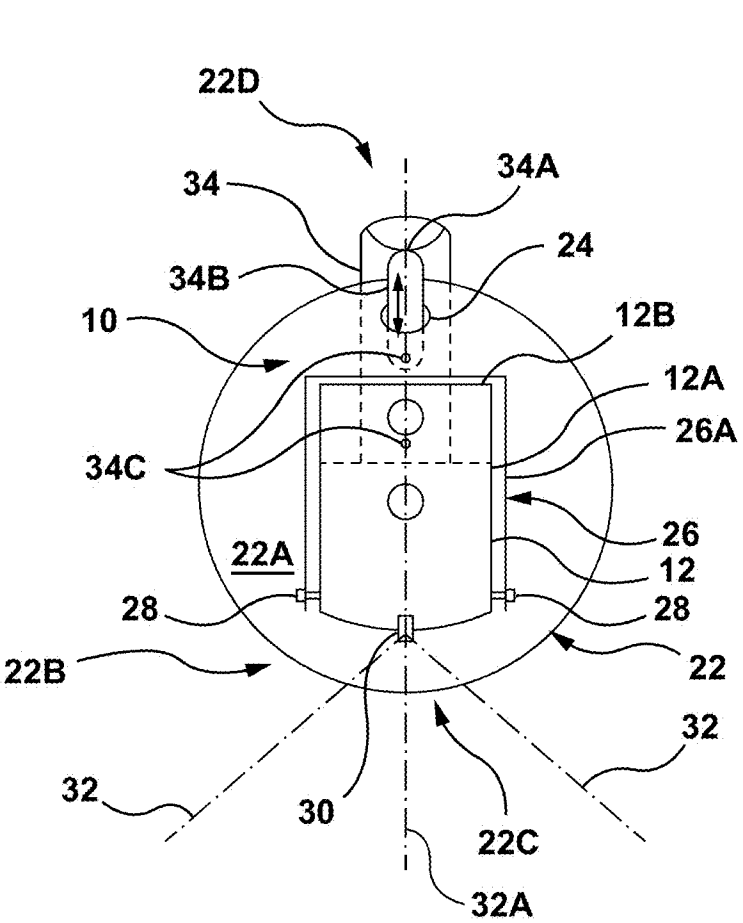
FIG. 2 is a top view of the adapter shown in FIG. 1.

One or more illustrative embodiments have been described by way of example. Described herein are apparatuses, tools, methods and uses thereof relating to abandonment of wells. It will be appreciated that embodiments and examples are provided for illustrative purposes intended for those skilled in the art, and are not meant to be limiting in any way. All references to embodiments, examples, aspects, formulas, compounds, compositions, solutions, kits and the like is intended to be illustrative and non-limiting.

An adaptor 10 for a cutter head 12 of a cutting device 14 is disclosed herein. Adaptor 10 may be used on a cutting device for cutting one or more well casings 16 on a well 18 for example in a well abandonment process. For example, adaptor 10 may be fastened to a high-pressure hydro-cutting device and deployed downhole for a desired downhole procedure, such as cutting casings during surface abandonment. In such examples and others, the adaptor may be used to shield or protect an object within the well, for example a cable or line, during cutting. In some cases, the object is a sensor cable 20 running downhole. Sensor cable 20 may run to the TD of the well 18. The adaptors described herein may be used in surface abandonment procedures, for example the removal of the upper portion (for example 1-5 m) of well 18. Well 18 may be any suitable well for abandonment, such as a stratigraphic test well, a non-thermally compliant well, an observation well, production well, SAGD well, or other candidate well for abandonment. Although examples described herein show the adaptor being used in partially or fully filled wells, the adaptor 10 may be used in any downhole application where it is desirable to protect a wire or line from a cutting device, such as a cutting torch, casing cutting device, or the abrasive/fluid stream of a hydro-jet cutter.

Figure 1:
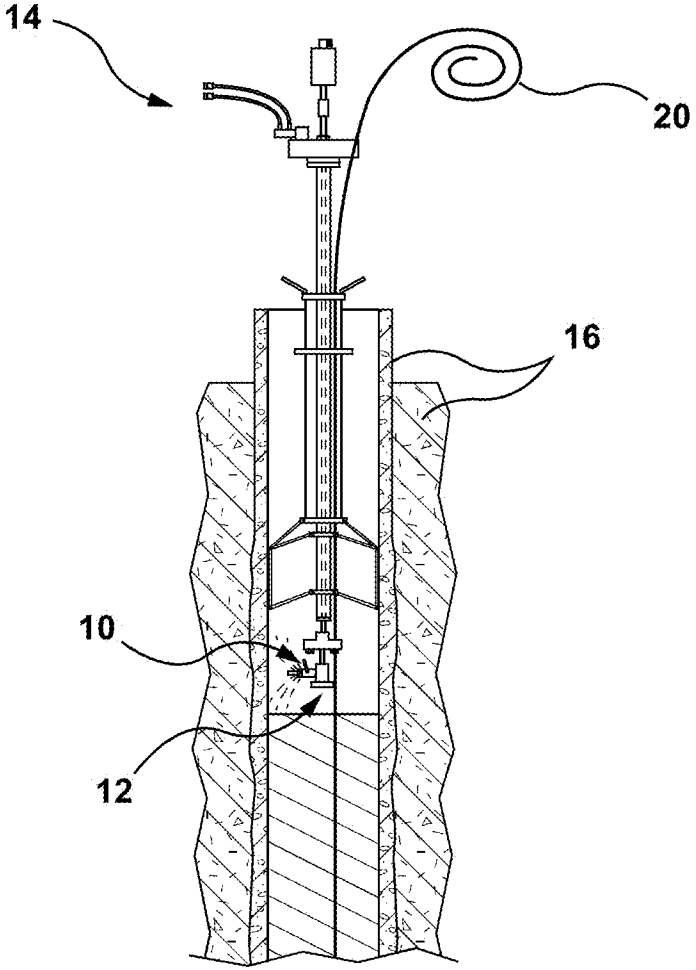
FIG. 1 is a schematic view of a downhole abandoned well with an embodiment of a cutting device and adapter inserted therein.

Cutter head 12 encompasses single or plural headed cutter heads, such as double headed. Examples of single headed embodiments of cutter head 12 are shown in FIGS. 1 and 2. Double headed or dual cutter heads may have more than one cutting tip 30. In some embodiments, the plural cutting tips are oriented such that both cutting tips align with axis 32A. Both cutting tips of dual cutter heads may share a manifold. Adaptor 10 may have an attachment bracket with side walls 26A that run along the sides 12A of the dual cutter head and accommodate both cutting tips. In some embodiments of adapter 10 for dual cutter heads, sensor aperture 24 and/or adjustment bracket 34 are located outside of the cutting paths of both cutting tips, such as next to one of the side walls 26A.

Referring to FIGS. 1 and 2, adaptor 10 comprises a base plate 22 that at least partially defines a sensor aperture 24 shaped to receive sensor cable 20. Adaptor 10 also comprises an attachment bracket 26 extending from a top face 22A of base plate 22. Adaptor 10 may also comprise one or more fasteners 28 for securing the attachment bracket 26 to the cutting device 14.

Referring to FIG. 2, base plate 22 may provide structure and shielding to the sensor cable 20 during operation of the cutting device. Base plate 22 may secure or anchor the cable 20 via aperture 24. Base plate 22 and aperture 24 may act to space the cable 20 from a cutting path 32. Base plate 22 comprises top face 22A, bottom face 22B, front end 22C and opposing rear end 22D.

Figure 3:
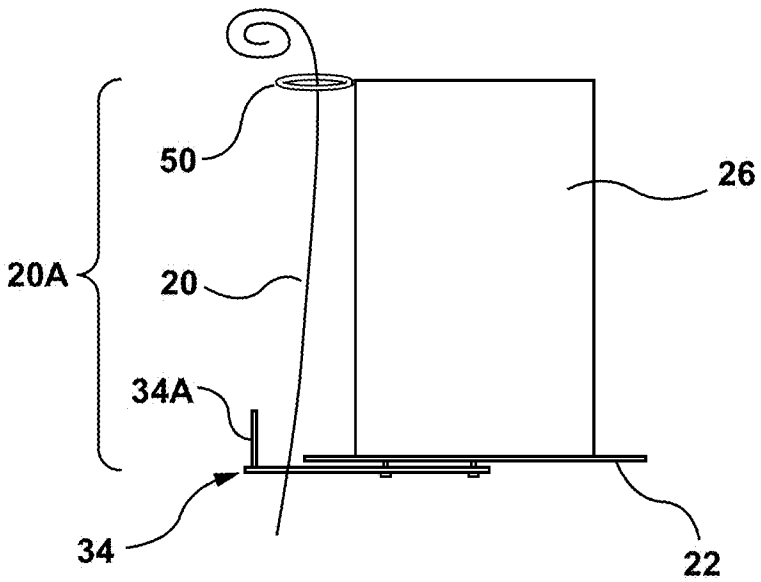
FIG. 3 is a side elevation view of the adaptor of FIG. 1.

Referring to FIG. 2, attachment bracket 26 is used to fasten or attach adaptor 10 to cutting device 14. Attachment bracket 26 may be shaped to co-operate with a cutter head 12. As shown in FIG. 2, bracket 26 may comprise a plurality of walls 26A that run along sides 12A and rear 12B of the cutter head 12. Attachment bracket 26 may also at least partially shield sensor cable 20 from output of the cutter head 12. The plurality of walls 26A may extend from the top face 22A of base plate 22 such that a portion 20A of the cable 20 is at least partially blocked or shielded from the output of cutter head 12 (FIG. 3). Attachment bracket 26 may be sized and shaped to accommodate a cutter head or tool part known in the art to which it is to be attached, for example the cutter head of an ultra-high pressure (UHP) cutter such as that shown in FIG. 4.

Referring to FIG. 2, sensor aperture 24 is formed at least partially by base plate 22. Sensor aperture 24 may be formed entirely by base plate 22 and, in such cases, may have an adequate shape to receive cable 20, such as a circular, oval, square, polygonal or elliptical. Sensor aperture 24 may be formed by base plate 22 and adjustment element 34. In such cases, base plate 22 may comprise a groove or notch to partially receive cable 20 and co-operate with a notch or groove in adjustment element 34 to form the aperture 24.

Sensor aperture 24 may be positioned away from the cutter tip 30 of cutting device 14. For example, sensor aperture 24 is outside a cutting path 32 of the cutter head 12. The cutting path may be defined as an area or path of output from cutter tip 30, for example path 32 as shown in FIG. 2. The area or path of output may be understood as the area where a percentage of abrasive fluid would be ejected from the cutting tip in use. Examples of suitable percentages include 70, 75, 80, 85, 90, 91, 92, 93, 94, 95, 96, 97, 98, 99, 99.5%, and others. Cutting path 32 may define a central cutting axis 32A extending laterally from the cutter tip. Sensor aperture 24 may at least partially overlap with the cutting axis 32A. Sensor aperture 24 may be adjacent to attachment bracket 26, for example a rear side of attachment bracket 26. Aperture 24 may be positioned at or near a rear end or portion 22D of base plate 22.

Referring to FIGS. 2 and 3, adaptor 10 may further comprise an adjustment element 34 for adjusting a width of sensor aperture 24. The adjustment element 34 may be secured to the base plate 22, for example at a bottom face 22B, via suitable attachment elements, such as one or more set screws 34C. The attachment elements may be reversible to allow adjustment element 34 to be removed and attached to adaptor 10. In some cases, the adjustment element 34 comprises an opening or slot 34B that forms part of the sensor aperture 24 . . . . In another example, the adjustment element 34 is shaped to co-operate with the base plate 22, such as in a tongue-in-groove arrangement. In some embodiments, adjustment element 34 comprises a handle 34A for gripping the part 34 while installing or removing from adaptor 10. Adjustment element 34 may be used to secure cable 20 to the adaptor 10 by: removing element 34, aligning cable 20 with a groove or notch in base plate 22, and reattaching element 34, thus forming the sensor aperture 24 and securing cable 20.

Referring to FIG. 2, adaptor 10 may be fastened to cutting device 14 via any suitable method. In some cases, adaptor 10 is fastened or otherwise secured to cutter head 12 via one or more removable fasteners 28, such as set screws or others known in the art. Fasteners 28 may pass through base plate 22 and/or bracket 26 into cutting device 14. In some cases, a plurality of fasteners 28 secure bracket 26 to cutter head 12. In other cases, the adaptor is secured to the cutting device 14 via permanent fastening, such as welding.

Figure 15B:
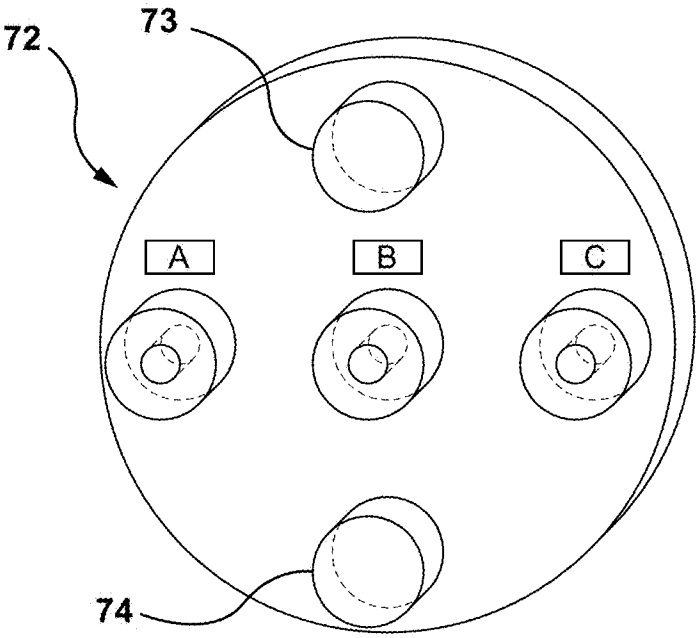
FIGS. 15A and 15B show an example of a manifold of a cutting device with apertures for receiving a sensor cable.
Figure 15A:
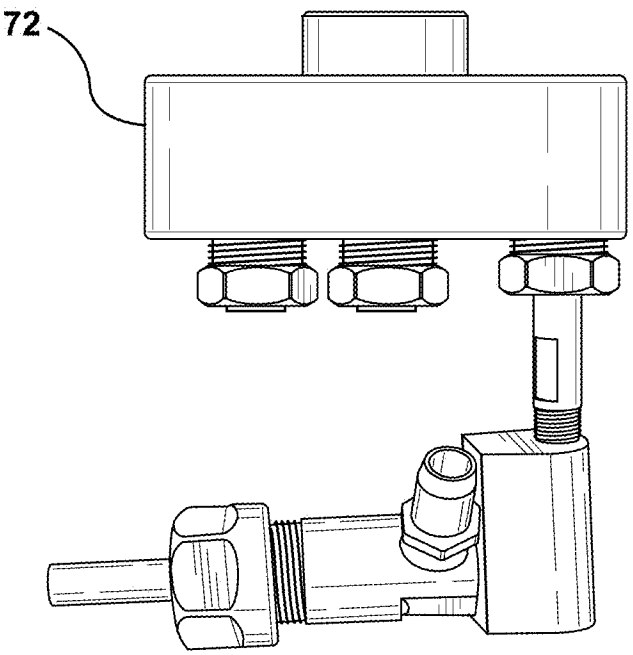

Referring to FIG. 3, adaptor 10 may further comprise an upper guide 50 for attaching to the sensor cable 20. Upper guide 50 may be mounted on an upper end 26A of the attachment bracket 26. Upper guide 50 may be vertically spaced from aperture 24. Attaching at a vertically spaced position along cable 20 may provide another anchor point for adaptor 10 and may provide increased control of the cable 20 while tool 14 is in use. Upper guide 50 may be any suitable gripping, guiding, engaging, or directing structure, such as one or more hooks or rings. In some cases, upper guide 50 may attach to or form part of a manifold of cutting device 10. Suitable manifolds are known in the art, such as those disclosed in FIG. 4 and U.S. Pat. No. 8,820,396. An example of a manifold 72 is shown in FIGS. 15A-B. The sensor cable 20 may be threaded through one or more apertures in the manifold 72, for example apertures 73 and 74.

Adaptor 10 may be used during a surface abandonment procedure. After well 18 has been filled by a suitable filling material 70, such as concrete, an upper portion of the concrete may be removed to make space for the insertion of a cutting device to remove the upper portion of the well casing. After this step, the adaptor may be installed/secured onto the cutting device 14. Securing adaptor 10 to the cutting device 14 may occur via the methods described herein. The sensor cable 20 may be threaded through aperture 24 and/or upper guide 50 before or after adaptor 10 has been secured to the tool. In embodiments with an adjustment element 34, the cable 20 may be first placed into the partially formed aperture of base plate 22. Attachment part 34 is then secured to base plate 22, forming aperture 24 and locking the cable 20 to the adaptor 10.

Referring to FIG. 1, sensor cable 20 may be any cable or string that requires protection during downhole procedures. During surface abandonment of a well, cable 20 may be a fiber optic cable that comprises one or more instrumentation lines. The cable 20 may be instrumentation for monitoring wells after abandonment. For example, sensor cable 20 may be a thermocouple, a fiber optic sensor, a geophone, a magnetic coil, a pressure sensor, or combinations thereof. Cable 20 may comprise any lines, wires or cables running downhole that a user wishes to protect. One or more instruments may be located at the downhole end of the cable, or in some cases, disposed along the cable 20.

Sensor cable 20 may be disposed within the well during abandonment. In some embodiments, a sensor cable may be outside/external to the well. External sensor cables may be in addition to sensor cable 20 disposed within the well. External sensor cables may be instrumentation lines connected to one or more pressure sensors located outside of the well at one or more suitable depths. Cable 20 may be located between casings. In some cases, cable 20 is disposed between the ID and the production casing.

Figure 4:
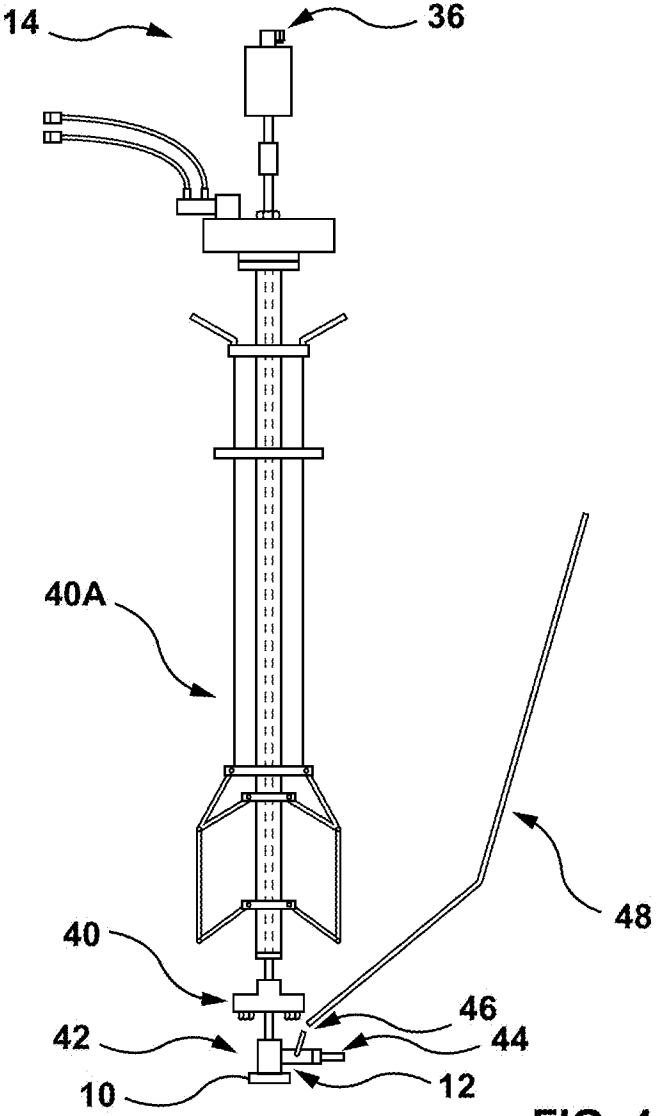
FIG. 4 is a schematic view of one embodiment of a UHP hydro cutter.

Referring to FIG. 4, adaptor 10 may be used on a cutting device known in the art, for example the ultra-high pressure (UHP) cutting device 14. Such cutting devices are known in the art, for example U.S. Pat. No. 8,820,396, herein incorporated by reference in its entirety. Such devices may produce a suitable output from cutter head 12, such as a mixture of abrasive and ultra-high pressure (UHP) fluid, to cut a casing and/or other component of a well to be abandoned.

The cutting device 14 shown in FIG. 4 may comprises a UHP hose connection 36 at a top of the cutting device so that a UHP hose may be connected for delivering fluid, such as water, from an UHP pump. Generally, the UHP hose is connected after insertion of the cutting device 14 into a wellbore, however, connection may be done before insertion of the cutting device into the wellbore. By positioning the UHP hose connection 36 at or near the top of the cutting device 14, connection of the UHP hose after insertion of the cutting device 14 is facilitated. This also helps to reduced tangling of the UHP hose and ease of rotation of the cutting device 14 during operation.

A UHP tube 38 extends to the bottom of the cutting device 14 and allows for fluid communication of the fluid with a UHP manifold 40 which directs the UHP fluid through a UHP elbow 42, generally of 90 degrees. The fluid then travels to the cutter head 12 and is directed out of the focus tube 44. The cutter head 12 includes an abrasive feed port 46 to which an abrasive feed line 48 is attached for supplying abrasive to the cutter head from an external abrasive source for combining with the fluid for eventual direction out through the focus tube 44. During normal operation, the abrasive that is fed to the cutter head 12 through the abrasive feed port 46 is drawn though the abrasive feed line 48 by suction, or a reduction in pressure, created by the high-pressure fluid, namely water, passing over the abrasive feed port 46 in the cutter head 12. Although device 14 is shown with a centralizer 40A, a person of skill in the art would understand that other centralizers/mounting means could be used to secure cutting device to the well in use.

Methods of abandoning and capping a well with a sensor cable are described herein. In some cases, the method comprises surface abandonment or "cut-and-cap" steps. The methods described herein may be used after a well has been considered plugged or downhole abandoned with a sensor disposed therein. Although examples of the methods provided herein utilize a UHP cutting device, a person of skill in the art would understand that other cutting devices known in the art may be used during abandonment procedures, such as a laser cutting device.

Methods for abandoning and capping a well with a sensor cable comprise feeding the sensor cable through an adaptor for a cutting device, inserting the cutting device into the well to a first depth, spacing the sensor cable from a cutting path of the cutting device via the adaptor, cutting the well at the first depth with the cutting device, and capping the well with a ported vented cap to allow passage of the sensor cable to the ground surface.

As shown in FIGS. 5-12, the methods described herein comprise one or more downhole abandonment procedures. Downhole abandonment procedures may be performed prior to or simultaneously with surface abandonment procedures.

Figure 5:
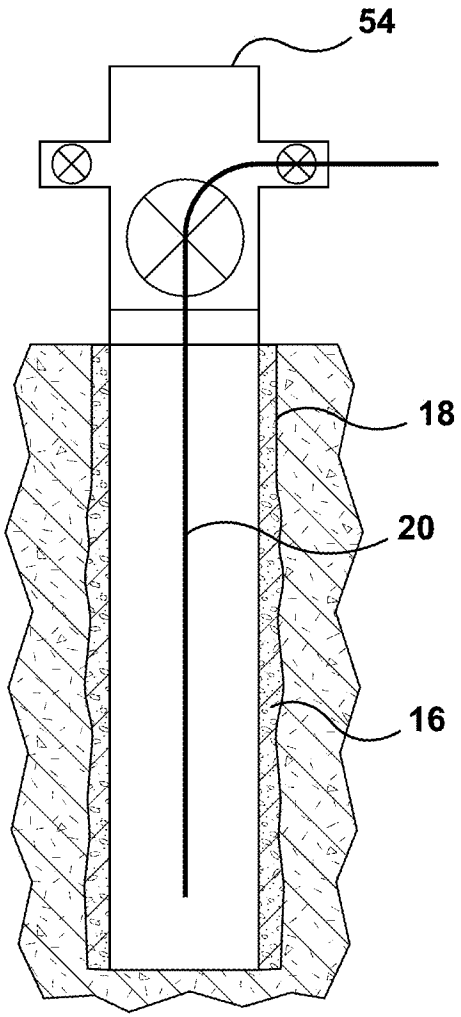

Sensor cable 20 may be installed via a suitable method. Methods of inserting cable 20 are known in the art, for example as disclosed in Canadian Patent application no. 2956165, which is herein incorporated by reference. In some embodiments, a tubing string is be fed into the well until the tubing string reaches an area proximate a true depth (TD) of the well, for example 1-50 m from the TD. As shown in FIG. 5, sensor cable 20 may then be fed into the well via a suitable method, such as along the tubing string or through a wellhead 54 until the sensor cable 20 reaches a preferred depth, such as the true depth (TD) or less, of the well for data collection. In these and other embodiments without a tubing string, sensor cable 20 may be gravity fed or pumped to the area proximate the TD of the well. In some cases, the cable 20 is attached to a sacrificial string or the tubing/casing. In cases where the well is horizontal, the cable 20 may be pumped to the area proximate the TD. While embodiments described herein show the cable 20 being fed to the area proximate the TD, a person of skill would understand that the cable 20 may be fed to any desired area inside or outside of the well to be abandoned. For example, cable 20 may be fed to an area halfway between the surface and the TD. In embodiments where a cable is exterior to the well, cable 20 may be clamped or strapped to the outside of the well. The abandonment methods described herein may also be undertaken on a well that already has a sensor cable 20 within or outside of the well.

Figure 6:
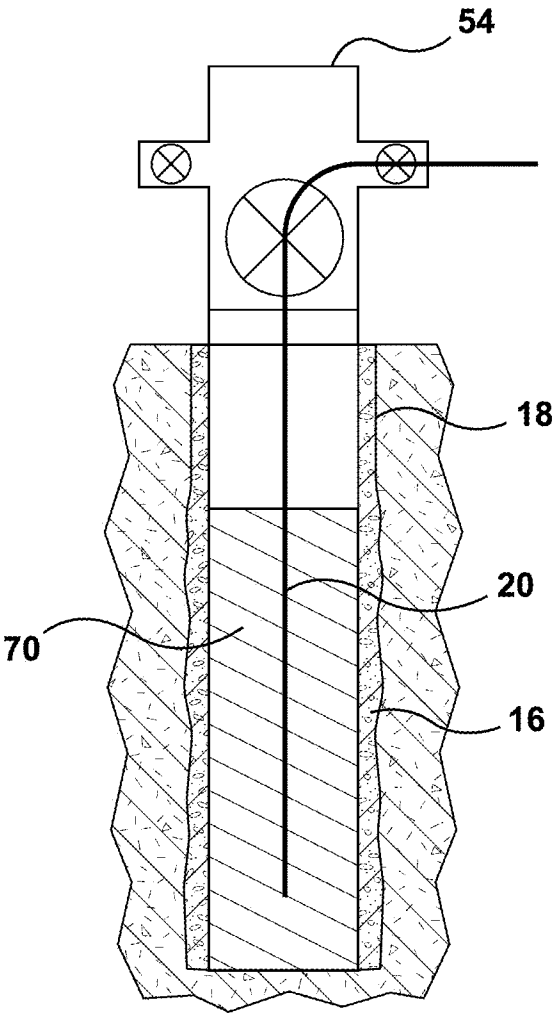
FIGS. 5-12 are schematic views depicting steps of a well abandonment procedure.
Figure 7:
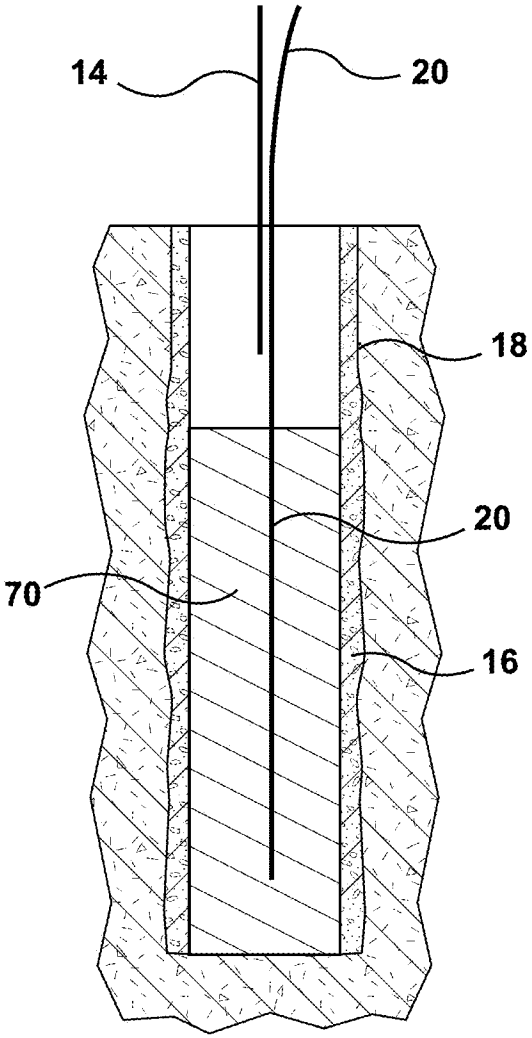

The well may then be filled with a first filler, such as concrete, to a first depth within the well, or to the surface, to seal the well and the sensor cable. The first filler may be added by a suitable method such as via the tubing string or though the wellhead 54. As shown in FIGS. 6 and 7, the wellhead 54 may be removed, if present, after the well has been at least partially filled by the first filler.

As shown in FIG. 7, the first filler may then be removed to a desired first depth, such as 1-10 m, to allow for cutting device 14 to be inserted into the tubing or casing. For example, in cases where concrete is used as the first filler, the concrete may be removed to the first depth prior to fully hardening/curing. The filler may be displaced via a suitable method, such as via a pump. The concrete may be removed after fully hardening/curing with a suitable tool, such as a jack hammer. The first filler may be added all at once or in stages/portions.

Figure 8:
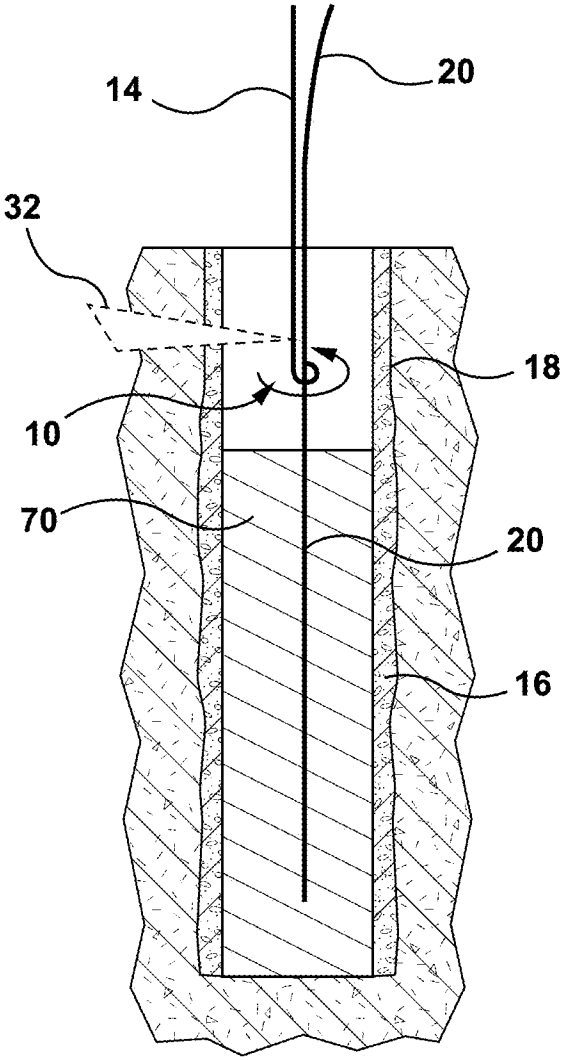

Referring to FIGS. 1 and 7-8, the cutting device 14 is inserted into the well at a first depth. In some cases, cutting device 14 is inserted after the well has been filled with the first filler material. Cutting device 14 may be inserted after concrete filler has been added and hardened. The UHP cutting device 14 may be inserted to the first depth, such as 1-5 m. Insertion of such cutting devices have been described previously in the art, for example in U.S. Pat. No. 8,820,396. For example, cutting device 14 may be inserted manually or using mechanical means, such as block and tackle, crane, excavator or others.

Referring to FIGS. 1 and 7-8, sensor cable 20 is spaced from cutting path 32 of cutting device 14. Spacing cable 20 from path 32 is spacing such that the cable 20 is non-overlapping with cutting path 32. Spacing cable 20 may act to isolate the cable from the cutting path 32 and deflections, debris and/or redirected output from the cutting head (such as abrasive fluid). In some cases, spacing cable 20 from cutting path 32 encompasses spacing via adaptor 10 secured to cutter head 12. Cable 20 is spaced from cutting path 32 for at least a portion of the cutting operation. In some cases, the cable 20 is spaced for the entire cutting operation. In other cases, cable 20 is spaced for only part of the cutting operation. For example, cable 20 may be cemented at or near a wall of casing 16 and the cable 20 and may only be spaced via adaptor 10 during a portion of the cutting operation. When the section of casing 16 near the cable 20 needs to be cut, the adaptor 10 may be detached from cable 20 and the remaining section is cut by a suitable cutting device, such as a manual cutting device, such as plasma or mechanical cutting device.

Figure 9:
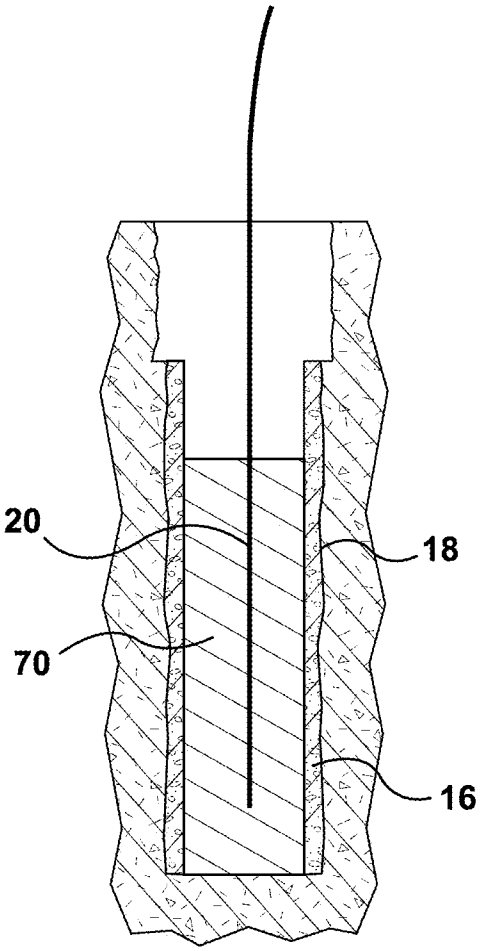

Referring to FIGS. 1 and 8-9, the well is cut by the cutting device at a suitable depth, for example the first depth. The cutting device may output a suitable cutting fluid, such as a mixture of abrasive and high-pressure fluid. Cutting device 14 and/or cutter head 12 may rotate about a rotation axis and cut the surrounding one or more well casings and tubing strings. In some cases, the cutter head rotates up to a 360° arc. In some cases, the cutter head is rotated less than 360° to avoid cutting a portion of the casing. The portion of the casing may be left uncut by cutting device 14 to avoid cutting an adjacent sensor cable or if sensor cable 20 is at or near a wall of the casing 16. Such leftover portions may be manually cut using a suitable tool. In such cases and others, cutting the well with cutting device 14 encompasses two or more cutting devices, such as a hydrojet, plasma or mechanical cutter. The cutter head may be angled such that the cutter head and cutting path is pointing toward or away from a direction of rotation of the cutter head. The angle of the cutter head may be adjusted during the cutting operation. In some cases, the cutting operation includes rotating cutter head 12 in a first direction for a portion of the cut, then rotating cutter head 12 in a second opposing direction to finish the cut. In such cases, rotating cutter head 12 in two directions during the cutting procedure may act to relieve tortional stress on the cable 20 that may occur during the cutting operation. After the cutting operation is complete, the severed portion of the well casings and tubing strings may be removed as well as any filler material disposed therein (FIGS. 9-10).

Figure 10:
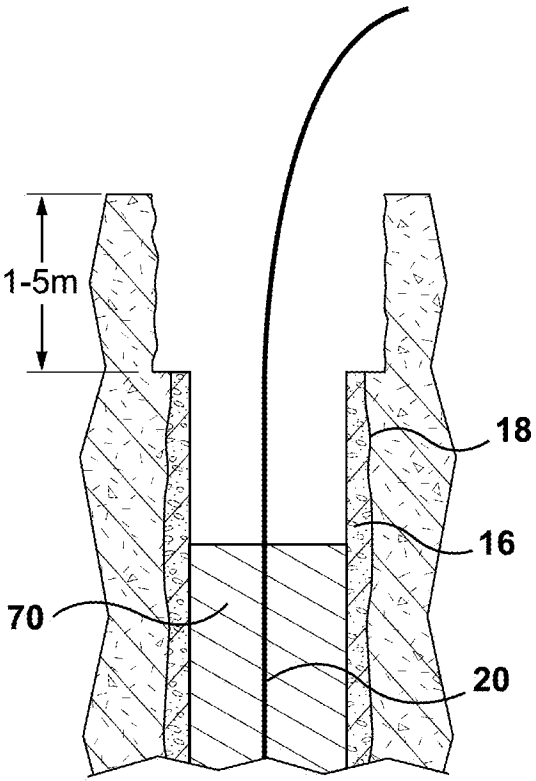

Referring to FIG. 10, the well casings and/or tubing strings may be cut at a first depth. The first depth may be between 0.5-10 meters, such as 1-5 meters. The depth of the cutting operation may be determined by local abandonment procedures. For example, if the downhole abandoned well is located in Alberta, Canada, the first depth may be within a range permitted by Directive 020.

Figure 11:
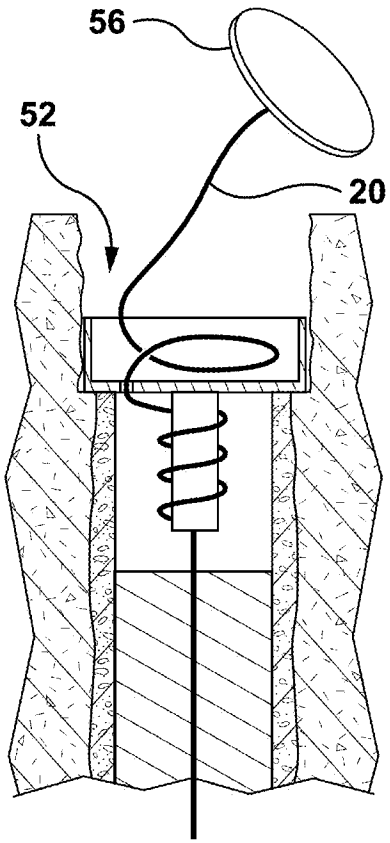
Figure 12:
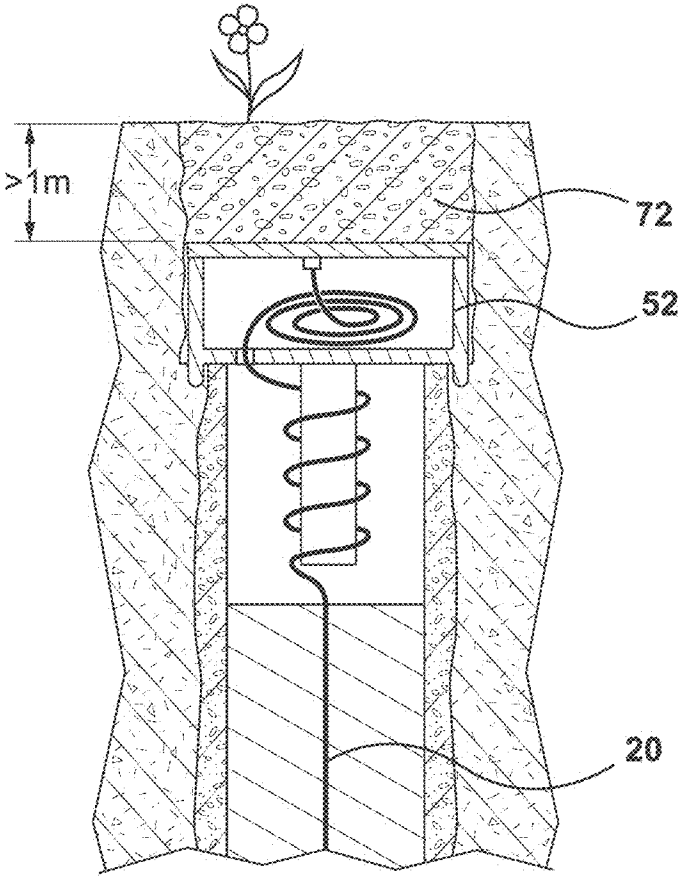

Referring to FIGS. 11-12, following the cut and removal of the severed portion of the well, the remaining intact well is then capped. The capping procedure may follow the regulatory requirements of the region in which the well is located. For example, if the well is located in Alberta, Canada, then the capping may follow the procedure as outlined in Directive 20. In some cases, the well will be capped with a vented cap 52. As shown in FIG. 12, vented cap 52 may cover the open end of the cut well. Vented cap 52 may permit passage of the sensor cable 20. Such vented caps may have an opening or port for the free end of the sensor cable. The free end of the cable may then be spooled and placed on a top side of the vented cap, such as within hollow interior 58. One of more fittings may be used to secure the cable to the vented cap. For example, fittings made by SWAGELOK™ and other secure fittings that provide movement of the cable above the fitting may be used. For example, a free end of cable 20 may be secured to lid 56 via a SWAGELOK™ fitting. Such lids or caps may be adorned with an "LSD" marking, which will be understood by a person of skill in the art as meaning "legal subdivision".

As shown in FIGS. 12, 13, 14A and 14B, the vented cap may be a spooling vented cap 52. Such embodiments of the vented cap may comprise a spool 60 extending from a bottom face 52D of base 52A of the cap 52. The spool 60 may have a suitable structure or shape for winding or spooling cable 20. In some cases, spool 60 comprises a groove or ramp for receiving cable 20. Spool 60 may have a suitable shape, such as a substantially frustoconical, cylindrical or conical shape. Spool 60 may be sized and/or shaped to fit within the well when installed. Spool 60 may be inserted into a cavity of well 18 created during abandonment procedures, such as after partial excavation/removal of the first filler.

Vented cap 52 may comprise an interior 58 for housing at least a part, such as a free end, of cable 20. The interior 58 may be defined by side walls 52B, base 52A and cover 56, such as in embodiments shown in FIGS. 12-13. In other embodiments, the cable 20 may be housed within an interior 58 defined by the base 58A and lip 66 (FIGS. 14A-14B). Base 52A may define a passage 52C for passage of the cable from the well to interior 58. Removable cover 56 may protected the cable 20 within interior 58 from the second filler, such as soil. Cover 56 may be removed to provide access to the free end of cable 20 for attaching to a surface acquisition box. Cover 56 may protect the cable 20 from damage caused by a user accessing the cable 20 via excavation of the dirt above the abandoned well. For example, the cover 56 may prevent a shovel or jackhammer from damaging the spooled cable 20 within the interior 58 when the reclaimed dirt/earth above the cap is being removed.

Referring to FIG. 14A, cap 52 may comprise a lower threading 68, such as male threading, for securing complementary threading 60A of spool 60, such as female threading, to base 52A.

Figure 13:
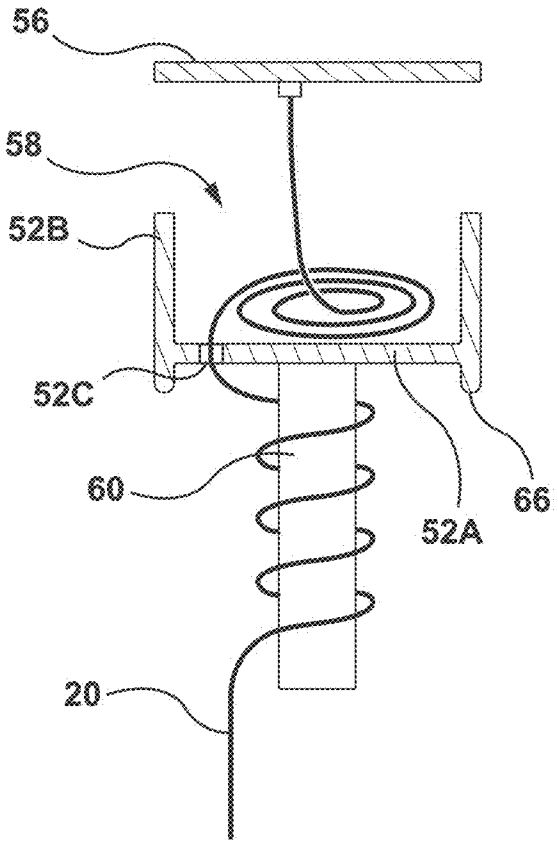
FIG. 13 is a schematic view of a spooling vented cap.
Figure 14B:
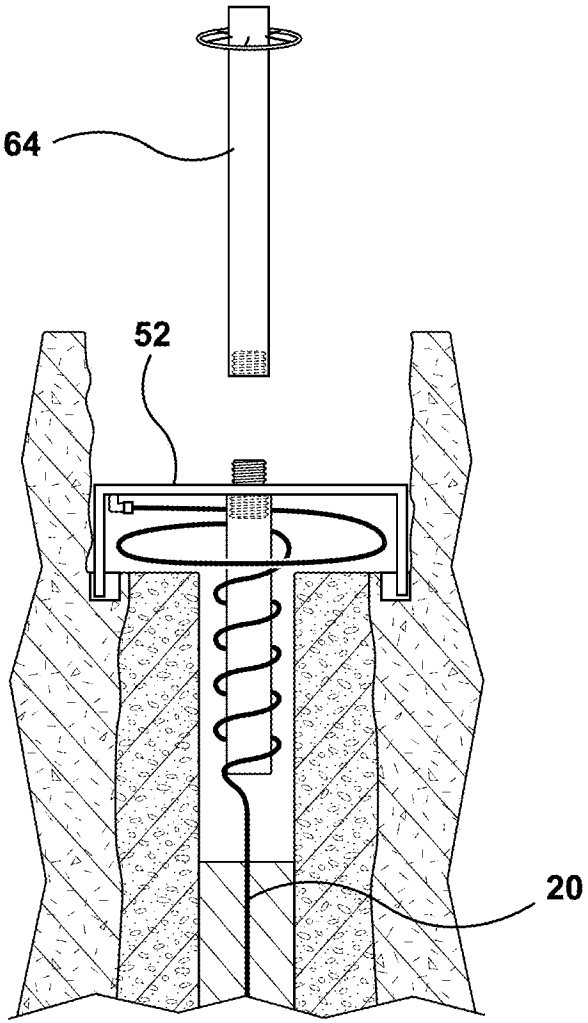
FIGS. 14A and 14B are schematic views depicting steps of installing an embodiment of a spooling vented cap.
Figure 14A:
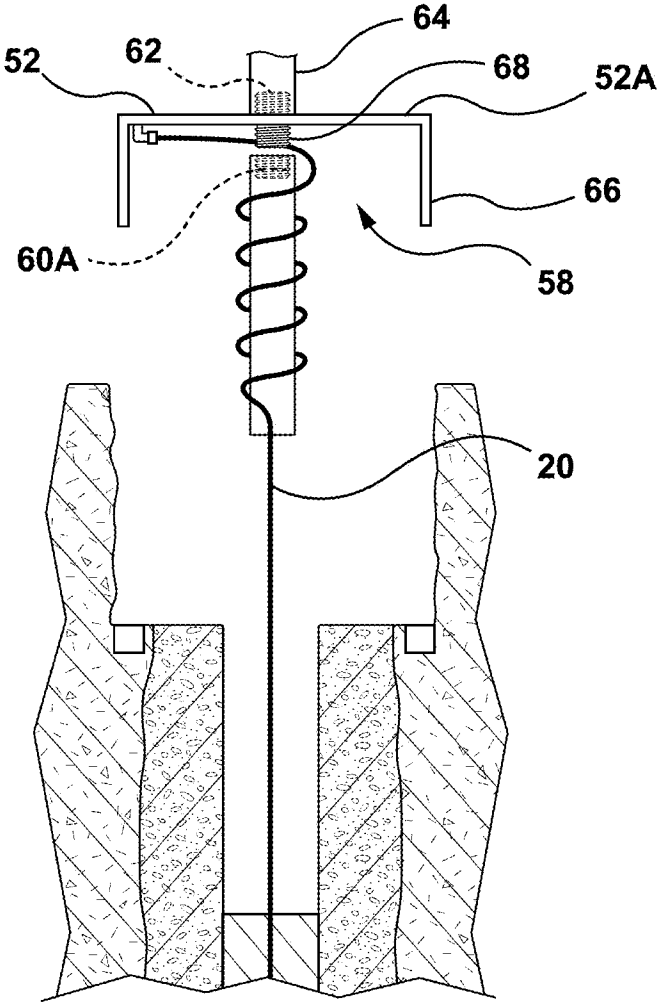

Referring to FIGS. 13 and 14A-B, cap 52 may be installed to cover or otherwise seal the top end of the well 18 after cutting. The free end of cable 20 may first be spooled around spool 60 and threaded through passage 52C. Passage 52C may comprise a fitting, such as a SWAGELOK™, for securing cable 20. The free portion of the cable 20 may then be wound and stored within interior 58. Free end of cable 20 may be secured to removable cover 56 such that the free end of the cable travels with the cover 56 when removed. The base 52A may comprise a top threading 62, such as male threading, that is complementary to threading on a pole 64, such as female threading. Pole 64 may be threaded or otherwise secured to the cap 52 for easier and/or more convenient handling by a user on the surface. The user may install cap 52 by twisting the cap into place on the top end of the well. Portions of soil surrounding the outer casing of the well may be removed prior to installation, for example in a 9-10-inch diameter. The base 52A may comprise a ledge or lip 66 shaped and sized to fit around at least part of the well 18, such as an exterior surface of outer casing of the well (FIGS. 14A and 14B). After the cap 52 has been twisted into place, the pole 64 may be removed from cap 52.

Referring to FIGS. 12 and 13, a protective cap may be provided to shield a portion of the sensor cable protruding from the ported vented cap. The protective sensor cap may be installed after installation of the first vented cap. The secondary cap may be used to protect the spooled sensor line that is threaded through the vented cap. The protective cap may be used to protect the sensor cable 20 from a second filler, such as dirt, poured to fill the hole between the first depth to the surface (FIG. 12). The second filler may be soil that is native to the area of the well. A buried, cut, and capped well may be referred to as a surface abandoned well. In some cases, the protective cap is a removable cover 56 for vented cap 52. In such embodiments and others, the vented cap may function as both a vented cap and a protective cap.

Free end of cable 20 may be spliced with one or more additional cables. For example, the cable 20 may be spliced with a flexible cable that can be manipulated or spooled within vented cap 52. Cable 20 may also be one or more cables. In some cases, the one or more cables 20 are bundled or spaced from one another. The one or more cables may be each connected to one or more sensors disposed at one or more areas interior or exterior to the well.

Following surface abandonment, the sensor cable may be used to gather information about the conditions of the abandoned well. The sensor cable may be connected to sensors located downhole. The soil or other filler may be removed to access one or more of the protective cap, vented cap or sensor cable 20. After the protective cap is removed (if present), the free end of the sensor cable may be pulled to the surface. A surface acquisition box or interrogator may then be secured to the free end and used to interrogate the sensor cable and provide/download well data from below the surface. Such data may include one or more of: geolocation, temperature, pressure, geophone or acoustic signature. In some cases, the cable 20 and/or surface acquisition box may be used to power instrumentation downhole, such as an electromagnet or other instrumentation known in the art that requires power from the surface. After the relevant data has been retrieved, and the free end of cable 20 has been returned placed back around/within vented cap 52, the land surrounding the well may be reclaimed as per local regulatory requirements.

An operator may acquire or power up downhole instrumentation via cable 20 over a suitable period. For example, an operator may acquire data over a short period, such as a minute, or over a longer period, such as up to a year or more.

After the well is abandoned, a permanent cable may be run from an MCC or control room to the abandoned well. Such cables may provide constant access to the sensor cable 20 and allow a user to receive data at any time without excavating the earth above the abandoned well. The permanent cable may be spliced into the free end of cable 20 that is housed within the vented cap/protective cap.

Although the examples described herein utilize a sensor cable 20 that is disposed within the well to be abandoned, there may be cases where the cable 20 runs along an exterior of the well. In some embodiments, the one or more cables 20 may be cemented or otherwise disposed between the inner (ID) and outer diameter (OD) of the well.

Although cutting device 14 is shown as an inside-out or internal cutter in the drawings, a person of skill in the art will understand that other cutting devices 14 may be used. For example, external cutting devices may be used, such as those described in U.S. Patent Application No. 63/300,307 filed Jan. 18, 2022, herein incorporated by reference in its entirety. Such external cutting devices may be angled during cutting procedures to avoid one or more instrumentation cables. In some cases, the cutting device 14 is a manual cutting torch operated by a user. In such cases, the well and concrete to be removed may be jack-hammered or otherwise excavated after the cutting operation.

All citations are hereby incorporated by reference. In the event of conflicting information with statements between any reference to or incorporated herein, and the present disclosure, the present disclosure will act as the guiding authority.

The present invention has been described with regard to one or more embodiments. However, it will be apparent to persons skilled in the art that a number of variations and modifications can be made without departing from the scope of the invention as defined in the claims.

What is claimed is:

1. An adaptor for a cutter head of a cutting device, the adaptor comprising:

a base plate at least partially defining a sensor aperture shaped to receive a sensor cable;

an attachment bracket for receiving the cutter head, the attachment bracket extending from a top face of the base plate; and wherein the sensor aperture is outside a cutting path of a cutter tip of the cutter head in use.

2. The adaptor of claim 1, further comprising an adjustment element removably secured to the base plate.

3. The adaptor of claim 2, wherein the sensor aperture is formed by the base plate and the adjustment element.

4. The adaptor of claim 1, wherein the sensor cable is a thermocouple, a fiber optic sensor, a geophone, a magnetic coil, a pressure sensor, or a combination thereof.

5. The adaptor of claim 1, wherein the sensor aperture is adjacent to the attachment bracket.

6. The adaptor of claim 1, wherein the cutting path defines a central cutting axis, and the sensor aperture at least partially overlaps with the cutting axis.

7. The adaptor of claim 1, wherein the cutting path is at least partially defined by a path of output from the cutter tip.

8. The adaptor of claim 7, wherein the output is a mixture of abrasive and ultra-high pressure (UHP) fluid.

9. The adaptor of claim 1, wherein the cutting device is an ultra-high pressure (UHP) cutting device.

10. The adaptor of claim 1, wherein the adaptor is for use in a well.

11. The adaptor of claim 10, wherein the well is a stratigraphic test well, a non-thermally compliant well, producing well, injector well, or an observation well.

12. The adaptor of claim 10, wherein the well is at least partially filled by filler material.

13. The adaptor of claim 1, wherein the adaptor further comprises an upper guide mounted on the attachment bracket for attaching to the sensor cable.

14. The adaptor of claim 1, further comprising a fastener for securing the attachment bracket to the cutter head.

15. An ultra-high pressure (UHP) cutting device for insertion into a wellbore for cutting the casing of the wellbore from within the wellbore while managing a sensor cable, the UHP cutting device, comprising:

a UHP hose connector for connection with a UHP hose in communication with a fluid source;

a rotatable UHP tube with a top end in fluid communication with the UHP hose connector and a bottom end opposite the top end;

rotating means in operational communication with the UHP tube for rotating the UHP tube during operation of the cutting device;

a cutter head in fluid communication with the bottom end of the UHP tube, the cutter head comprising:

a UHP elbow for changing the direction of UHP fluid flow from a direction substantially parallel with the wellbore to a direction toward the inner surface of the wellbore;

an abrasive feed port for connection with an abrasive feed line for receiving abrasive to be mixed with the UHP fluid; and a focus tube for directing the mixture of UHP fluid and abrasive out of a cutter tip of the cutter head and toward the inner surface of the wellbore to be cut; and an adaptor for a cutter head of a cutting device for managing a sensor cable, the adaptor comprising:

a base plate at least partially defining a sensor aperture shaped to receive the sensor cable;

an attachment bracket for receiving the cutter head, the attachment bracket extending from a top face of the base plate; and a fastener for securing the attachment bracket to the cutter head;

wherein the sensor aperture is outside a cutting path of the cutter tip in use.

16. A method for abandoning and capping a well with a sensor cable, the method comprising:

feeding a tubing string into the well until the tubing string reaches an area proximate a true depth of the well;

feeding the sensor cable into the tubing string until the sensor cable reaches the true depth of the well;

filling the tubing string with a first filler to a first depth within the well to seal the well, the tubing string and the sensor cable;

removing a portion of the first filler to a first depth;

spacing the sensor cable from a cutting path of a cutting device;

inserting the cutting device into the well to the first depth;

cutting the well at the first depth with the cutting device;

capping the well with a ported vented cap to allow passage of the sensor cable to the ground surface; and providing a protective cap for the sensor cable protruding from the ported vented cap to shield the sensor cable.

17. The method of claim 16, wherein the cutting device is an UHP hydro-jet cutting device.

18. The method of claim 16, wherein the cutting device is an internal cutting device sized to fit within the wellbore to be cut.

19. The method of claim 16, wherein the step of spacing is carried out for a portion or all of the step of cutting.

* * * * *